US006390105B1

(12) United States Patent
Ramsey

(10) Patent No.: US 6,390,105 B1
(45) Date of Patent: May 21, 2002

(54) SMALL DIAMETER PIPE AND TUBE CLEANING APPARATUS

(76) Inventor: Donald Ramsey, 962 Cornell Ave., Youngstown, OH (US) 44502

( * ) Notice: Subject to any disclaimer, the term of this patent is extended or adjusted under 35 U.S.C. 154(b) by 0 days.

(21) Appl. No.: 09/542,013

(22) Filed: Apr. 3, 2000

(51) Int. Cl.[7] ..... B08B 3/02; B08B 9/12

(52) U.S. Cl. ..... 134/167 C; 134/167 R; 134/167 C; 134/168 R; 134/168 C; 118/306

(58) Field of Search ..... 134/167 R, 167 C, 134/168 C, 168 R; 118/306

(56) References Cited

U.S. PATENT DOCUMENTS 2,017,042 A * 10/1935 Dougherty ..... 91/25
3,071,107 A * 1/1963 Stanley ..... 118/306
3,106,491 A * 10/1963 Leibner ..... 118/2
3,449,783 A 6/1969 Kirschke
3,994,310 A 11/1976 Brandon
4,206,313 A 6/1980 Cavoretto
4,337,723 A * 7/1982 Davis ..... 118/306
4,559,960 A 12/1985 Lanier
4,690,159 A * 9/1987 Vadakin et al. ..... 134/167 C
5,038,810 A * 8/1991 Pacheco et al. ..... 134/167 C
5,113,885 A 5/1992 Ramsey
5,444,887 A 8/1995 Rufolo
5,829,461 A * 11/1998 Ramsey ..... 134/167 R

* cited by examiner

*Primary Examiner*—Randy Gulakowski
*Assistant Examiner*—Joseph Perrin
(74) *Attorney, Agent, or Firm*—Harpman & Harpman

(57) ABSTRACT

An apparatus for cleaning the interior of small diameter pipes. The apparatus has high-pressure rotary fluid distribution nozzles on a rotating bracket carried on a movable platform. The apparatus is self-centering within the pipe with ultra high-pressure fluid swivels and quick disconnect air and fluid supply fittings associated therewith.

16 Claims, 8 Drawing Sheets

SMALL DIAMETER PIPE AND TUBE CLEANING APPARATUS

BACKGROUND OF THE INVENTION

1. Technical Field

This device relates to pipe cleaning devices that travel through the interior of a pipeline and cleaning the interior surface as they go. These types of devices use a mechanical and/or fluid under high pressure to scour the interior surface of debris and are usually pulled through by auxiliary means.

2. Description of Prior Art

Prior art devices of this type have relied on a variety of structures having multiple cleaning heads on guide and support structures that position the cleaning heads in contact with the surface to be cleaned. See for example U.S. Pat. Nos. 3,449,783, 3,994,310, 4,206,313, 4,559,960, 5,113,885, and 5,444,887.

In U.S. Pat. No. 3,449,783 a hydraulic waste disposal line cleaner is disclosed having a high-pressure source of fluid 600 to 1,000 PSI with jet propulsion means that drives the tool forward into the waste disposal line utilizing cleaning pressure fluid.

U.S. Pat. No. 3,994,310 is directed to a duct cleaning apparatus having a pair of fluid nozzles rotatably positioned on a support and supply arm with guide strips extending therefrom.

U.S. Pat. No. 4,206,313 on a pipe cleaning nozzle having multiple skids to space a nozzle body within a pipe. High-pressure fluid is discharged propelling the nozzle through the pipe.

A sewer cleaning apparatus is disclosed in U.S. Pat. No. 4,559,960 wherein a wheeled cartridge is pulled through a sewer line with a scraping disk mechanically engaging the interior walls.

Applicant's U.S. Pat. No. 5,113,885 discloses a pipe cleaning apparatus wherein a support platform carries and positioned a rotating spray nozzle as the assembly is pulled through the pipe.

U.S. Pat. No. 5,444,887 discloses an underwater pipe cleaning device having scraper blades carried by a support frame that is pulled through the pipe.

Applicant's U.S. Pat. No. 5,829,461 discloses an interior tank cleaning apparatus for tanks and large pipes having multiple nozzle heads on a rotating arm assembly supported and positioned by a wheel support assembly.

SUMMARY OF THE INVENTION

A cleaning device for small diameter pipes to remove deposits and build-up from the interior surface thereof. The cleaning device uses ultra high-pressure water dispensed from multiple nozzle heads on a rotating support bracket positioned on a positioning and rotation assembly that engages the interior pipe surface.

DESCRIPTION OF THE PREFERRED EMBODIMENT

Figure 1:
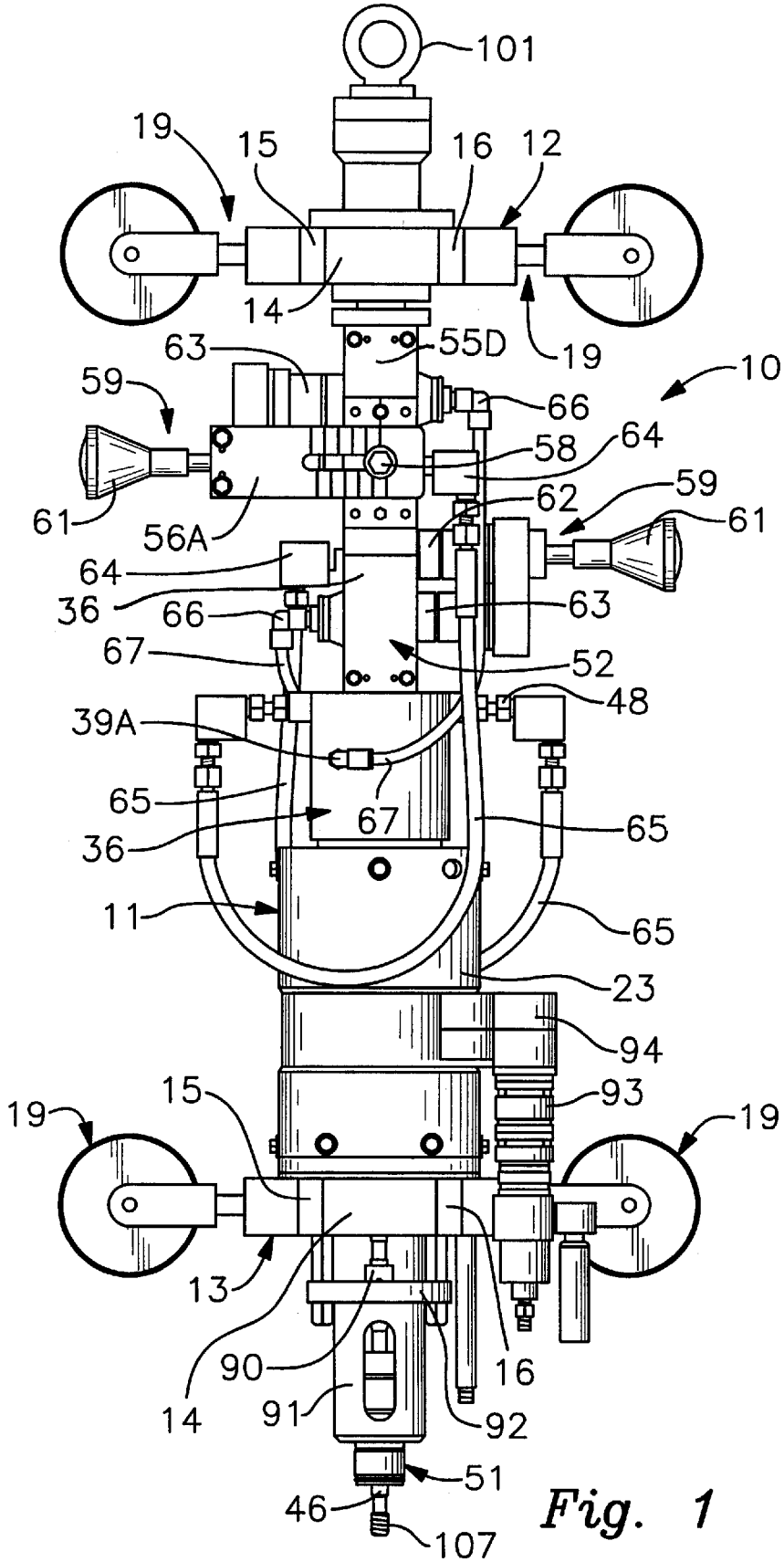
FIG. 1 is an elevational view of the cleaning device of the invention.
Figure 2:
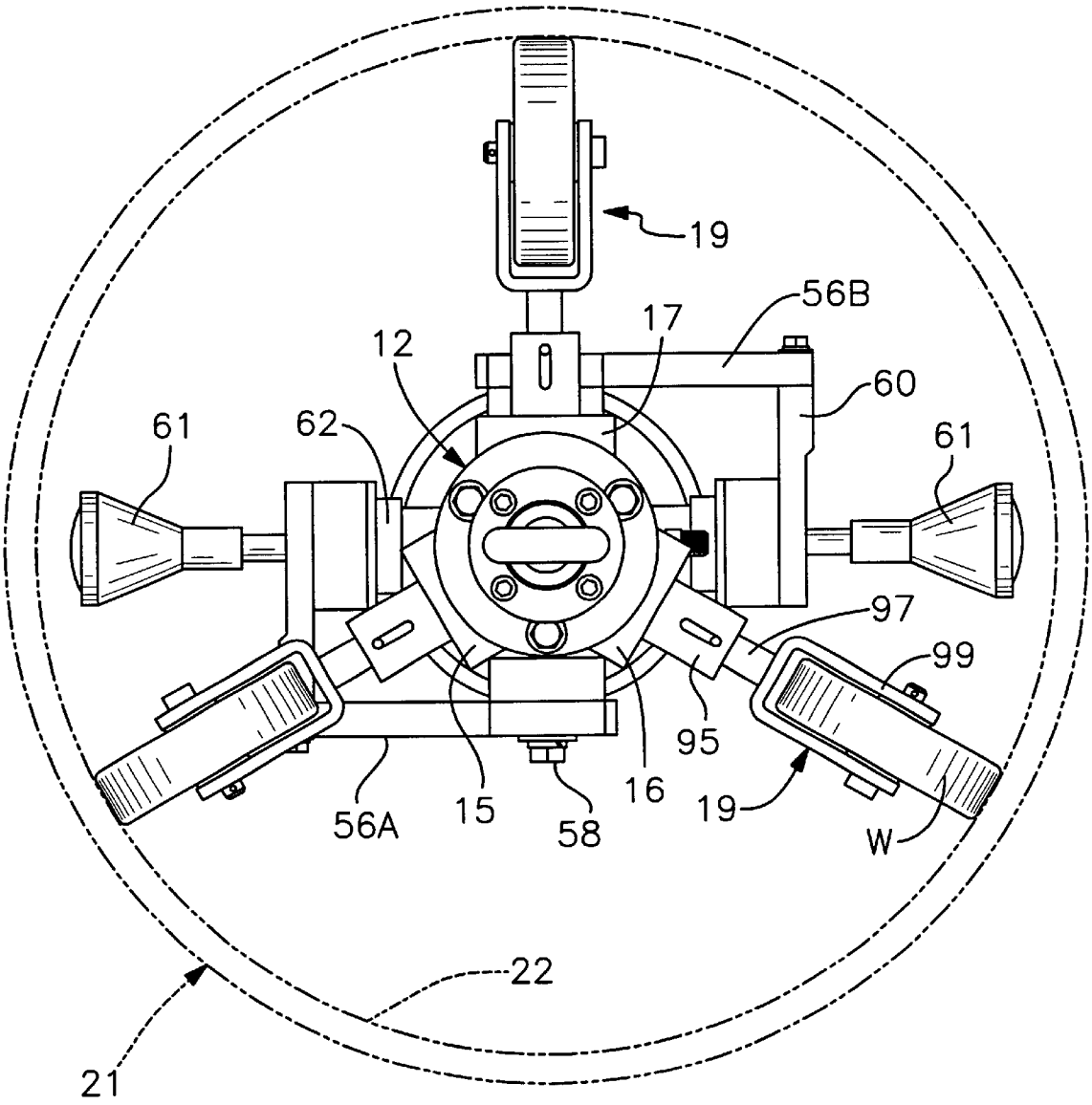
FIG. 2 is a top plan view of the cleaning device of the invention in a pipe representation shown in broken lines.
Figure 3A:
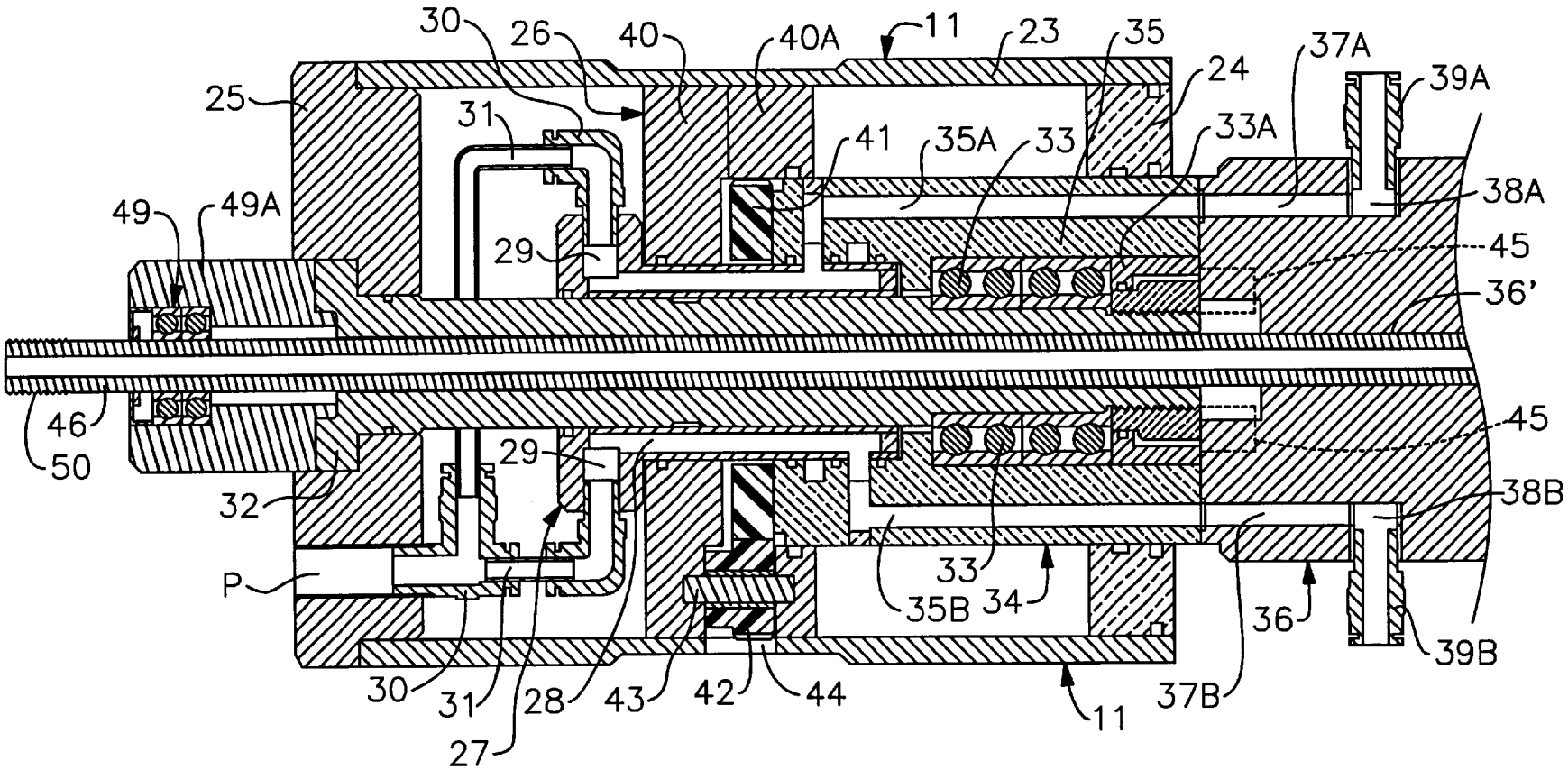
FIG. 3A is a cross-sectional view of a central power hub of the invention with portions broken away.
Figure 3B:
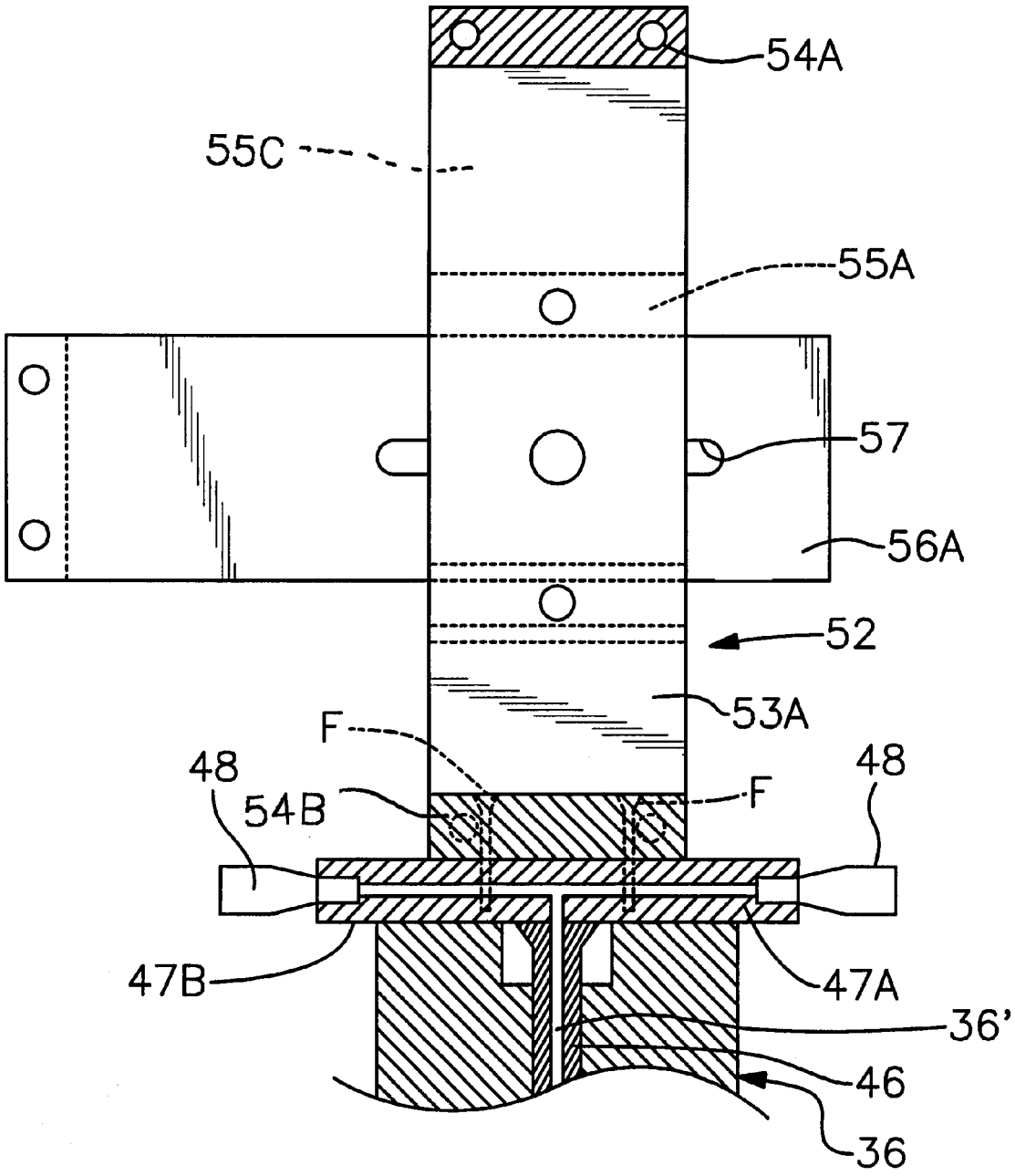
FIG. 3B is a cross-sectional view of the central power hub of the invention with portions broken away.

Referring to FIGS. 1–3 of the drawings, a small diameter cleaning device 10 can be seen having a main support body member 11 with a pair of oppositely disposed wheel support assemblies 12 and 13 extending therefrom. Each of the wheel support assemblies has a support hub 14 secured to the main support body member 11. Each of the hubs 14 have multiple annularly spaced mounting surfaces 15, 16 and 17 from which extends respective self-centering spring-loaded wheel mounts 19. The wheel support assemblies 12 and 13 are self-centering within a small diameter pipe 21 having an interior surface 22 shown in broken lines in FIG. 2 of the drawings. It will be apparent that as the spring-loaded wheel assemblies 12 and 13 correspondingly engage the inner interior surface 22 of the small diameter pipe 21, the main support body member 11 is "centered" within.

Referring now to FIGS. 1–3A of the drawings, the main support body member 11 has a cylinder housing 23 with a front bushing 24, an oppositely disposed apertured end cap 25 with an apertured center support fitting 26 therebetween. An air swivel fitting assembly 27 is positioned within the central fitting 26 having an annular air passage 28 with multiple air inlet ports 29 therein. An air supply fitting 30 with associated interconnected piping 31 extends from the apertured end cap 25 to the air inlet ports 29. An apertured central shaft 32 is registerably positioned through the respective end cap 25 and air swivel fitting assembly 27. A pair of bearing assemblies 33 are positioned on the central shaft 32 by a bearing retainer 33A and a shaft nut 33B threadably disposed thereon. The bearing assemblies 33 rotatably position a spray bracket support hub assembly 34 having a bearing engagement portion 35 within the cylinder housing 23.

The spray bracket support hub assembly 34 has longitudinally extending air channels 35A and 35B and a spray bracket engagement portion 36 extending outwardly from the cylindrical housing 23. The spray bracket engagement portion 36 has longitudinally extending air channels 37A and 37B therein that are in communication with the air channels 36A and 36B respectively with outlet ports and connector fittings 38A and 38B and 39A and 39B respectively.

The central support fitting 26 forms the lower half of a headgear drive box enclosure 40 with an upper half 40A defining the gearbox enclosure 40 having a main drive gear head 41 within the central support fitting 26. An idler gear 42 on a shaft 43 engages the main gear 41 and is accessible by an opening at 44 in the main support body member 11 as will be explained in greater detail hereinafter.

The spray bracket engagement portion 36 has a central bore 36' therethrough and is aligned for engagement and secured to the bearing engagement portion 35 by interconnecting pins 45 and fasteners F extending through registration openings F1 therein. A high-pressure fluid feed pipe 46 is rotatably positioned through the central bore 36' of the center shaft 32 and has a t-shaped outlet at 47A and 47B with respective high-pressure fluid couplings 48 within.

Referring back to FIG. 3A of the drawings, a pipe support bearing assembly 49 is positioned in a pipe and rear leg support fitting 49A extending from the end of the central shaft 32. The free end of the fluid feed pipe 46 is externally threaded at 50 to registerably receive a fluid swivel assembly 51, best seen in FIGS. 1 and 6 of the drawings.

Figure 4:
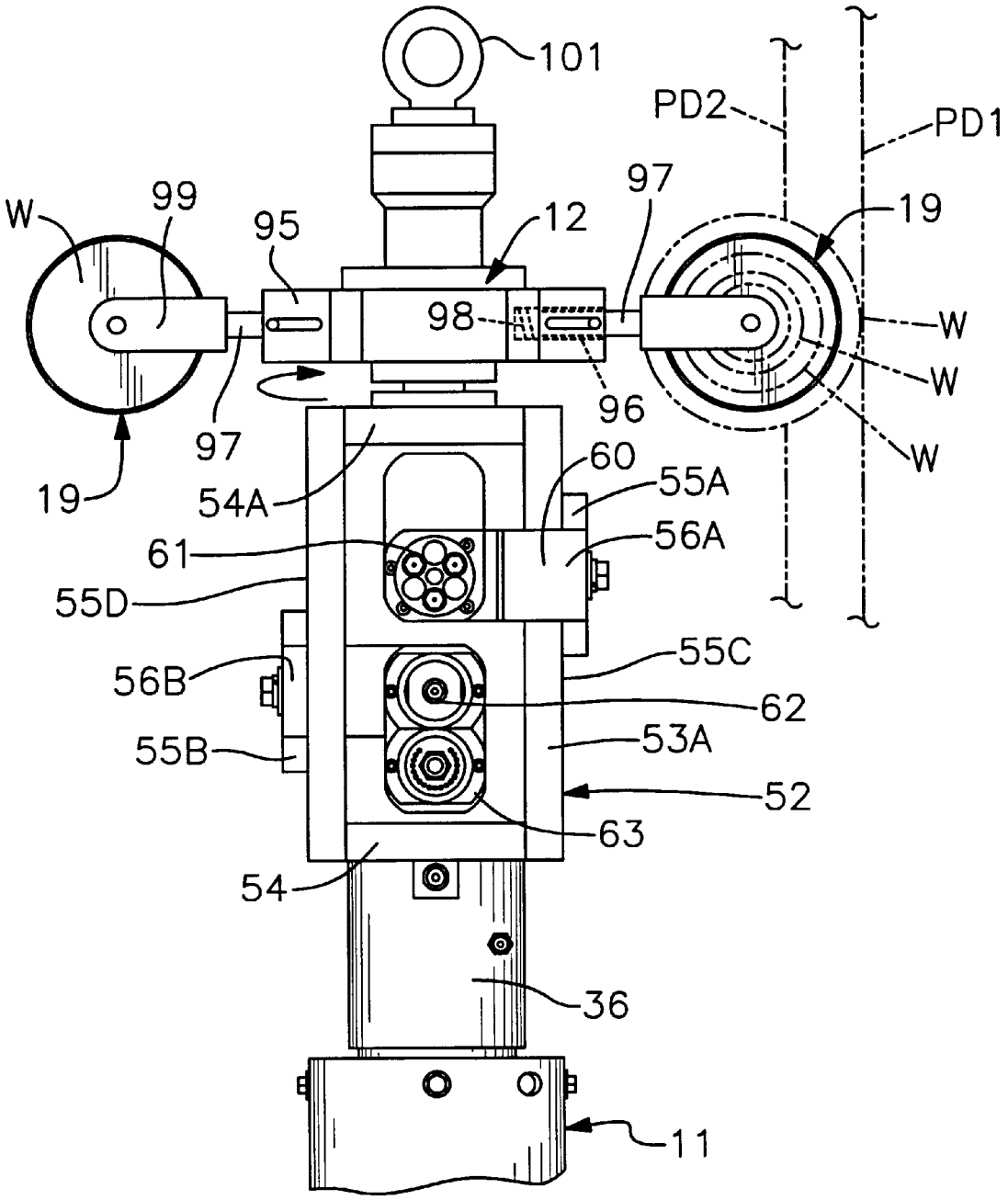
FIG. 4 is a side elevational view of a cleaning head support bracket of the invention.
Figure 5:
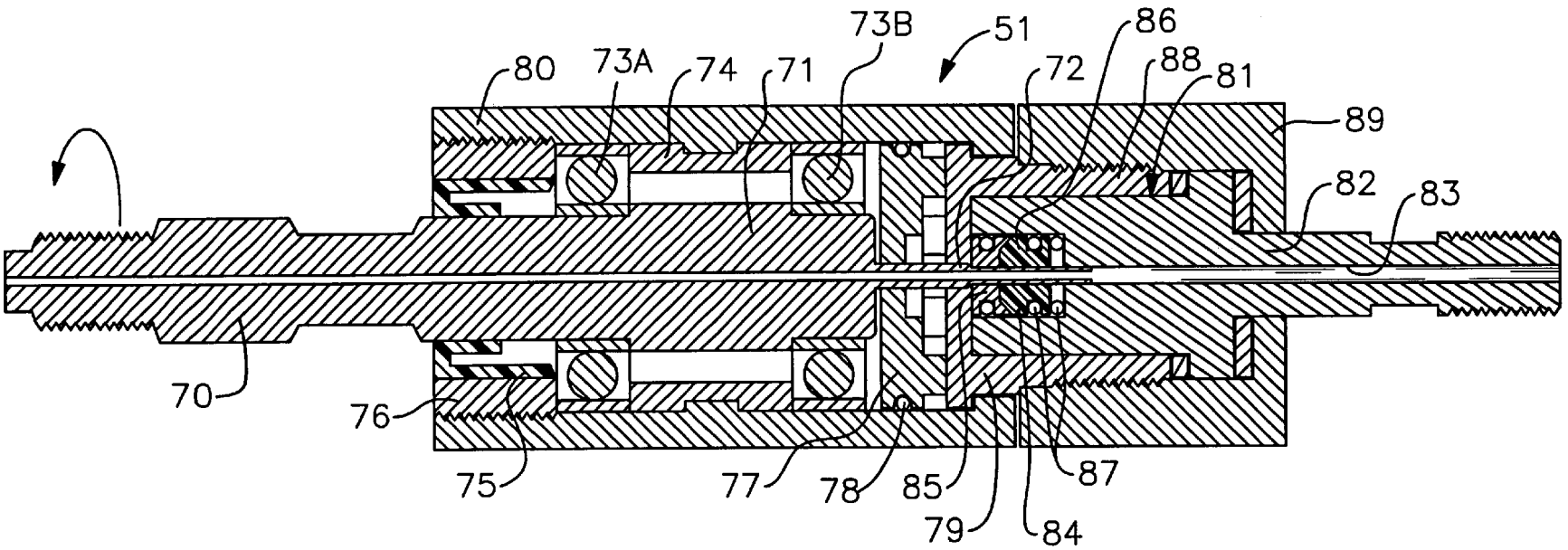
FIG. 5 is an enlarged cross-sectional view of a high-pressure fluid swivel.
Figure 6:
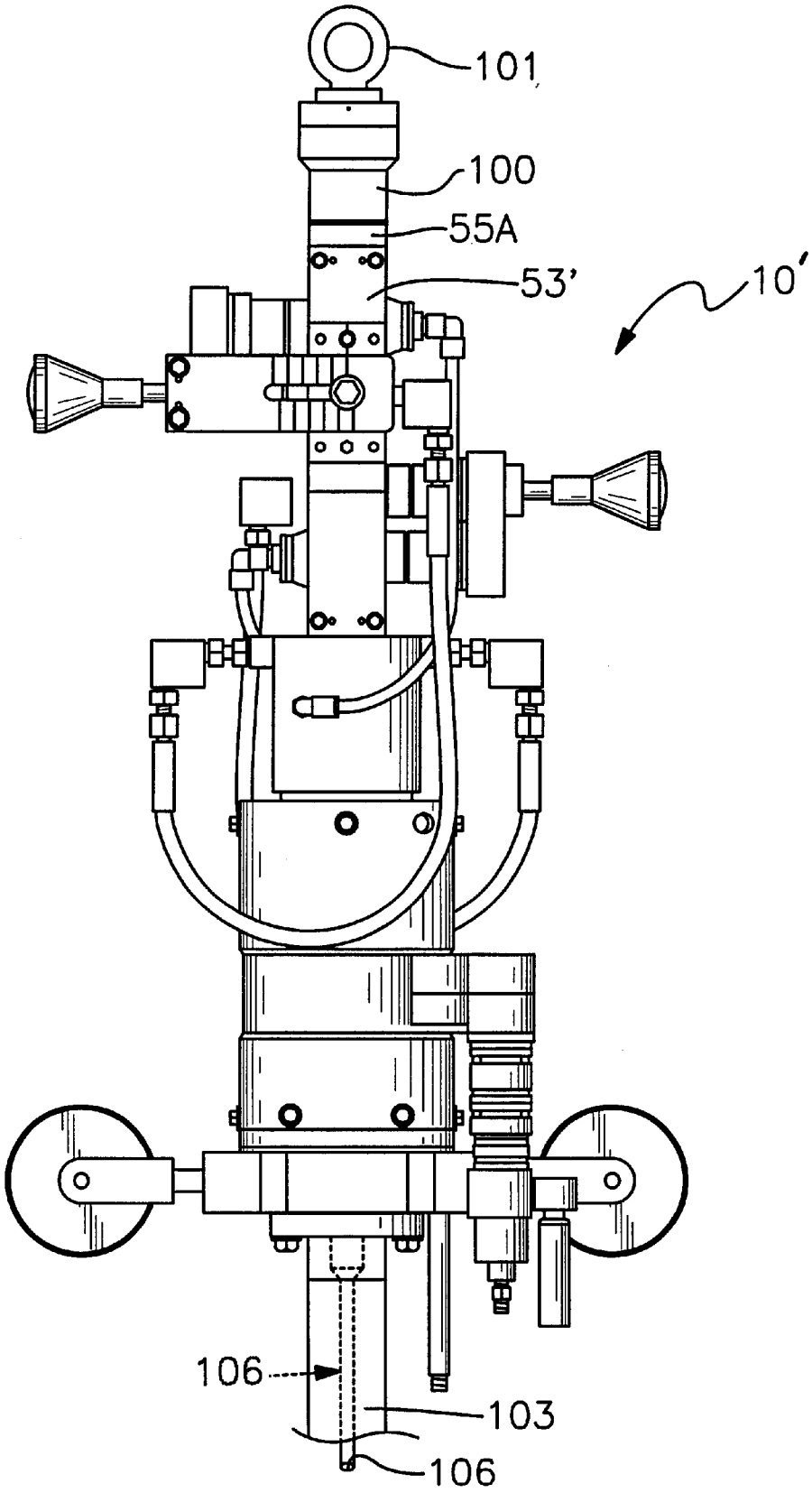
FIG. 6 is a side elevational view of an alternate form of the invention having modified wheel support assemblies with portions broken away.

A spray head mounting bracket assembly 52 can be seen secured to and extending from the spray bracket engagement portion 36. The mounting bracket assembly 52 has a pair of parallel spaced engagement bars 53A and 53B interconnected by respective base and top bars 54A and 54B. The base bar 54B is secured to the spray bracket engagement portion 36 by fasteners F with the wheel assembly 12 secured to and extending from the top bar 54A. The engagement bars 53A and 53B have mounting block pairs 55A and 55B on the respective outer surfaces 55C and 55D. A pair of spray head brackets 56A and 56B are adjustably secured to the engagement bars 53A and 53B between the hereinbefore described mounting block pairs 55A and 55B as best seen in FIGS. 4, 5, and 6 of the drawings. The spray head brackets 56A and 56B have an elongated adjustment aperture at 57 therein with which a locking bolt 58 extends so as to selectively secure the bracket 56A and 56B.

Nozzle assemblies 59 are respectively secured to brackets 60 which extend from the engagement bars 53A and 53B. The nozzle assemblies 59 have multiple outlet rotatable spray heads 61 connected to a second high pressure fluid swivel 62 and a source of fluid under ultra high pressure as will be described in greater detail hereinafter.

Air motors 63 are positioned on the respective support bracket 60 adjacent said respective high pressure fluid swivel 62 and are in geared connection with the respective nozzle assemblies 59 by a pair of inter-meshing gears (not shown) as will be well understood by those skilled in the art.

Fluid couplings 64 and flexible fluid supply lines 65 interconnect the fluid swivel 62 with the high-pressure spray heads 61.

Air fittings 66 and flexible air supply lines 7 interconnect the air couplings 39A and 39B with the air motors 63 on the spray head mounting assemblies 52.

Referring now to FIG. 5 of the drawings the fluid swivel assembly 51 can be seen having a main shaft 70 with an area of increased diameter at 71 and a reduced diameter at 72. A pair of bearings 73A and 73B are positioned on the shaft 70 adjacent the are of increased diameter at 71 with a split bearing spacer 74 therebetween. A lock nut gear seal 75 and bearing lock nut 76 are positioned on the main shaft 70 abutting said bearing 73A. A weep plate 77 with a weep plate seal 78 is positioned on the shaft's area of reduced diameter at 72 adjacent the bearing 73B with a seal holder housing 79. The shaft 70 and related assemblies are slideably positioned within a swivel housing 80 being threadably secured thereto by a lock nut 76 positioned thereon. A high-pressure seal assembly 81 is registerable within the seal holder housing 79 on the area of reduced diameter at 72. The high pressure seal assembly 81 has a seal body 82 with a central bore 83 therethrough and a seal receiving bore area 84 with a seal bushing 85, nylon seal element 86 and O-rings 87 therein. The seal holder housing 79 has an externally threaded portion 88 with a retaining nut 89 threadably disposed thereon. Referring to FIG. 1 of the drawings, the fluid swivel 51 is interconnected to the inlet end of the fluid feed pipe 46 by a coupling 90 and is positioned in a support bracket 91 extending from a rear leg mounting assembly 92 on the hub 14.

In operation, to remove and/or disconnect the identical high pressure fluid swivel assemblies 51 and 62 the retaining nut 89 (having left hand threads) is removed by hand, thus removing the sealing assembly 81 therefrom as will be well understood by those skilled in the art.

Referring now back to FIG. 1 of the drawings, the small diameter cleaning device 10 is shown having a main air drive motor 93 and a drive gear assembly housing 94 mounted on the cylindrical housing 23 so as to be registerable with the idler gear 42 through the opening 44 in the main support body 11 so as to rotate the spray bracket support assembly thereon.

Referring now to FIG. 4 of the drawings, the self-centering spring-loaded wheel assemblies 19 are shown each having a mounting base 95 that is secured to the hereinbefore-described support hub 14's multiple surfaces 15, 16, and 17 by fasteners F. The mounting base 95 has a central bore at 96 into which a wheel rod 97 is registerably positioned. Springs 98 within each of the central bores 96 provide resilient force thereto. A bifurcated mounting bracket 99 extends from the wheel rod 97 and has a wheel W rotatably positioned therein as will be well understood by those skilled in the art. Each of the bifurcated mounting brackets 99 is capable of interchanging a variety of different diameter wheels as indicated by broken lines W so as to accommodate different interior pipe dimensions illustrated by broken lines PD1 and PD2.

For use a source of cleaning fluid (water) under ultra high pressure for cleaning purposes (not shown) is connected to an inlet 107 of the high pressure fluid swivel 51 providing fluid through the fluid supply pipe 46 and the respective oppositely disposed high pressure couplings 48 which are in turn interconnected by respective high pressure fluid lines 65 and couplings to the fluid swivel 51' on the spray nozzle assemblies on the support bracket.

A source of air pressure (not shown) is connected to the inlet port (P) of the high pressure fittings 30 and thus applies air swivels 27 with air pressure within the annular air passages at 28 and to the respective air channels 35A and 35B to the respective outlet ports 37 and 38 which in turn supply the outlet ports 38A and 38B and respective quick release couplings 39A and 39B.

Interconnecting air lines 67 extend from the respective couplings 39A and 39B to the air motors 63 providing activation air thereto.

Figure 7:
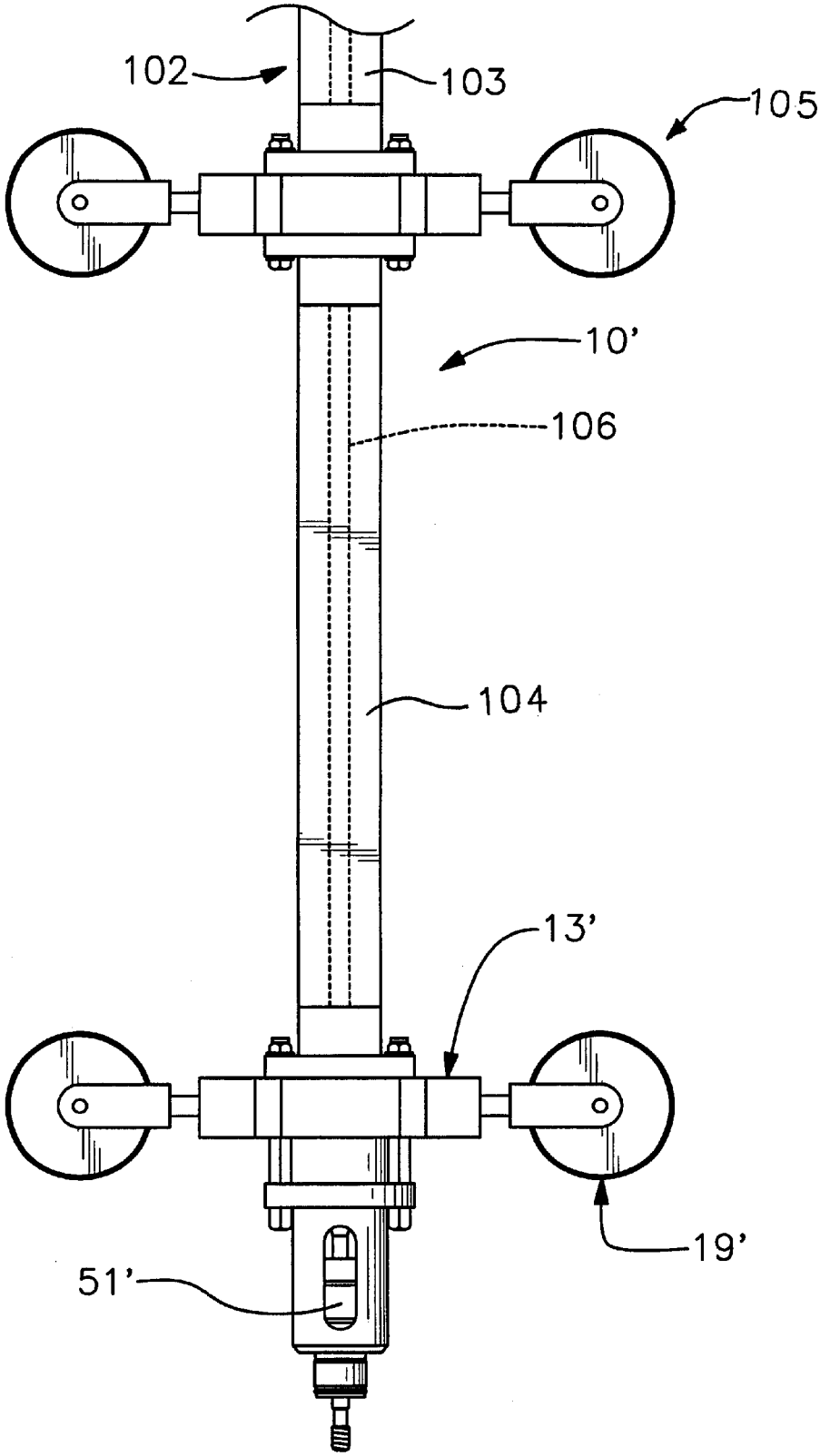
FIG. 7 is a side elevational view of the alternate form of the invention set forth in FIG. 6 showing modified wheel support assemblies and fluid couplings.

Referring now to FIGS. 6 and 7 of the drawings, an alternate form of the small diameter pipe cleaning device 10' can be seen wherein wheel support assembly and associated wheels have been removed so that only a pull hub 100 extends there beyond. The pull hub 100 extends from a top bar 55A' of a mounting bracket 53' with an engagement eye hook 101 extending therefrom.

An ultra high-pressure swivel assembly 51' is repositioned with a wheel assembly 13' to a tail extension 102 which is secured in place thereof. The tail extension 102 has a first and second support and mounting tubes 103 and 104 with a wheel assembly 105 secured therebetween. An inner fluid transfer conduit 106 extends through the respective support tubes 103 and 104 so as to provide a source of fluid under ultra high pressure.

The respective wheel assemblies 13' and interconnected high pressure swivel assembly 51' are secured to the distal end of the second extension tube 104 with the fluid transfer conduit 106 communicating with the high pressure swivel assembly 51'.

The use of the alternate form of the invention 10' is applicable in situations wherein the amount of internal build-up material to be removed from a pipe prevents initial proper wheel engagement.

The cleaning devices 10 and 10' of the invention are manually pulled through a pipe to be cleaned by an outside conveyance (not shown) connected to the engagement lug 101 on the front hub 100 thereof.

It will thus be seen that a new and novel small diameter pipe cleaning device has been illustrated and described and it will be apparent to those skilled in the art that various changes and modifications may be made therein without departing from the spirit of the invention.

Therefore I claim:

1. An apparatus for cleaning an interior surface of a small diameter pipe comprising; a main support body having a front bushing and oppositely disposed apertured end cap therein, a wheel support assembly extending from said main support body, a central shaft within said main support body, a support hub rotatably positioned on said central shaft in said front bushing, a spray head mounting bracket extending from said support hub, a second wheel assembly extending from said mounting bracket, spray head brackets adjustably secured to said mounting bracket, spray nozzle assemblies supported on said respective spray head brackets, air supply channels in said support hub, an air supply swivel fitting rotatably positioned on said central shaft, an annular air supply passageway in said air supply swivel fitting having inlet and outlet ports in communication with a source of air under pressure and said annular air supply passageway respectively, a fluid supply pipe rotatably positioned through said central shaft, means for rotating said support hub and means for rotatably connecting said fluid supply pipe to a source of fluid under pressure and to said spray nozzle assemblies.

2. The apparatus as set forth in claim 1 wherein said wheel support assemblies comprise; mounting hubs, annular spaced mounting surfaces on said hubs, wheel mounts extending from said respective mounting surfaces, resilient wheel assemblies extending from the free ends of said respective wheel mounts.

3. The apparatus set forth in claim 1 wherein said spray nozzle assemblies comprise; a rotatable spray head on said respective spray head brackets, means for interconnecting said spray heads with said fluid supply pipe, and means for rotating said spray heads.

4. The apparatus set forth in claim 1 wherein said means for rotatably connecting said fluid supply pipe to a source of fluid under pressure to said spray nozzle assemblies comprises; a fluid swivel.

5. The apparatus set forth in claim 1 wherein said means for rotating said support hub comprises; a drive gear on said hub, an air motor engaged on said drive gear and a source of air under pressure for said motor.

6. The apparatus set forth in claim 1 wherein said spray head mounting bracket comprises; a base bar secured to said hub, a pair of engagement bars extending from said base bar, a top bar secured between said engagement bars in spaced relation to said base bar mounting block pairs secured to said respective engagement bars for registration with said respective spray head brackets therebetween.

7. The apparatus set forth in claim 4 wherein said fluid swivel comprises; a housing, fluid supply shaft within said housing, a central bore through said shaft, bearing assemblies on said supply shaft, a seal holder extending from said housing, a sealing body registerable in said seal holder having a central bore therein, multiple sealing elements within said sealing body registerable on portions of said support shaft and means for threadably securing said sealing body to said housing.

8. The apparatus as set forth in claim 3 wherein said means for interconnecting said spray heads with a fluid supply pipe comprises; flexible fluid supply lines intercommunicating with high pressure fluid coupling on multiple fluid outlets and means for rotating said spray heads comprises; an air motor and gear assembly on said mounting bracket and a source of air under pressure for said air motors.

9. An apparatus for cleaning an interior surface of a small diameter pipe comprising; a main support body having a front bushing and an oppositely disposed apertured end cap therein, a wheel support assembly extending from said main support body, a central shaft within said main support body, a support hub rotatably positioned on said central shaft in said front bushing, a spray head mounting bracket extending from said support hub, spray nozzle assemblies adjustably positioned on said mounting bracket, air supply channels in said support hub, an air supply swivel fitting rotatably positioned on said central shaft, an annular air supply passageway in said air supply swivel fitting having inlet and outlet ports in communication with a source of air under pressure and said annular air passageways respectively, a fluid supply pipe rotatably positioned through said central shaft, means for rotating said support hub, means for rotatably connecting said fluid supply pipe to a source of fluid under high pressure and to said spray nozzle assemblies, an extension assembly extending from said wheel support assembly, said extension assembly comprising a first and second tubular member, an extension wheel assembly positioned therebetween, a second wheel support assembly on a distal end of said second tubular member, a fluid supply pipe extending through said respective tubular members and said wheel support assemblies.

10. The apparatus set forth in claim 9 wherein said wheel support assemblies comprises; mounting hubs, annularly spaced mounting surfaces on said hubs, wheel mounts extending from said respective mounting surfaces, resilient wheel assemblies extending from the free ends of said respective wheel mounts.

11. The apparatus set forth in claim 9 wherein said spray nozzle assemblies comprises; a drive and support bracket adjustably positioned on said spray head mounting bracket, a rotatable spray head on said drive and support bracket, means for rotating said spray head and means for interconnecting said spray heads with said fluid supply pipe and means for rotating said spray head.

12. The apparatus set forth in claim 9 wherein said means for rotatably connecting said fluid supply pipe to a source of fluid and to said spray nozzle assemblies comprises; a fluid swivel.

13. The apparatus set forth in claim 9 wherein said means for rotating said support hub comprises; a drive gear on said support hub, an air motor engaged on said drive gear and a source of air under pressure for said motor.

14. The apparatus set forth in claim 9 wherein said spray head mounting bracket comprises; a base bar secured to said support hub, a pair of engagement bars extending from said base bar, a top bar secured between said engagement bars in spaced relation to said base bar and adjustment brackets secured to said respective engagement bars.

15. The apparatus as set forth in claim 11 wherein said means for rotating said spray heads comprises; an air motor and gear assembly on said respective drive and support bracket and a source of air under pressure for said air motors.

16. The apparatus as set forth in claim 11 wherein said means for interconnecting said spray heads with said fluid supply pipe comprises; flexible fluid supply lines in communication with high pressure fluid couplings on multiple fluid outlets.

* * * * *